US006118852A

United States Patent [19]

Rogers et al.

[11] Patent Number: 6,118,852

[45] Date of Patent: Sep. 12, 2000

[54] ALUMINUM X-RAY TRANSMISSIVE WINDOW FOR AN X-RAY TUBE VACUUM VESSEL

[75] Inventors: Carey S. Rogers, Waukesha; Charles B. Kendall, Brookfield, both of Wis.

[73] Assignee: General Electric Company, Milwaukee, Wis.

[21] Appl. No.: 09/109,753

[22] Filed: Jul. 2, 1998

[51] Int. Cl.[7] ..... H01J 5/18

[52] U.S. Cl. ..... 378/140

[58] Field of Search ..... 378/140, 161

[56] References Cited

U.S. PATENT DOCUMENTS

| | | | |
|---|---|---|---|
| 2,665,391 | 1/1954 | Bleeksma | 313/59 |
| 2,955,219 | 10/1960 | Niklas | 313/65 |
| 3,287,581 | 11/1966 | Rome et al. | 313/59 |
| 3,419,741 | 12/1968 | Legendre | 313/59 |
| 4,045,699 | 8/1977 | Gunther | 313/59 |
| 4,119,234 | 10/1978 | Kotschak et al. | 220/2.1 R |
| 4,153,854 | 5/1979 | Chrisgau et al. | 313/101 |
| 4,763,042 | 8/1988 | Colomb et al. | 313/544 |
| 5,159,621 | 10/1992 | Watanabe | 378/161 |
| 5,828,727 | 10/1998 | Schild | 378/140 |

*Primary Examiner*—Craig E. Church

*Attorney, Agent, or Firm*—Kilpatrick Stockton; Christian G. Cabou; Phyllis Y. Price

[57] ABSTRACT

An x-ray transmissive window assembly for use in metal framed x-ray tubes is formed of at least two layers of metal joined by explosion welding. An x-ray transmissive window, preferably comprising aluminum or an aluminum alloy, is joined to a transition layer, which is typically the same material as the x-ray tube vacuum vessel, to form the transmissive window assembly. The transmissive window is formed in the assembly by removing the transition layer material from the central region. A weld flange is prepared by removing the x-ray transmissive window material from the periphery of the assembly. The assembly is then welded into the x-ray tube vacuum vessel using traditional techniques. In another embodiment, a multi-layered window assembly comprises an x-ray transmissive window, a transition layer weldable to an x-ray tube vacuum vessel, and an intermediate layer that acts as a mask or aperture to attenuate peripheral radiation and clearly define the edges of the transmitted x-ray beam. The intermediate layer also acts as a diffusion barrier that prevents the formation of a brittle intermetallic layer between the transmissive window and transition layers during high temperature operation. Additionally, according to the present invention, an x-ray system comprising the above-described window assembly is disclosed.

37 Claims, 5 Drawing Sheets

ALUMINUM X-RAY TRANSMISSIVE WINDOW FOR AN X-RAY TUBE VACUUM VESSEL

FIELD OF THE INVENTION

The present invention relates to x-ray beam generating devices, and more particularly, to an x-ray transmissive window of an x-ray tube vacuum vessel.

BACKGROUND

Typically, an x-ray beam generating device, referred to as an x-ray tube, comprises opposed electrodes enclosed within a cylindrical vacuum vessel. The vacuum vessel is typically fabricated from a glass tube or a cylinder made of metal, such as stainless steel, copper or a copper alloy. One of the electrodes comprises the cathode assembly which is positioned at some distance from the target track of a rotating, disc-shaped anode assembly. The impact zone of the anode is generally fabricated from a refractory metal with a high atomic number, such as tungsten or tungsten alloy. A typical voltage difference of 80 kV to 140 kV is applied across the cathode and anode assemblies. Thermal electrons are emitted by the hot cathode filament and accelerated across the potential difference impacting the target zone of the anode at high velocity. A small fraction of the kinetic energy of the electrons is converted to high energy electromagnetic radiation, x-rays, with the balance being converted to heat. The x-rays radiate from the focal spot in all directions. An x-ray transmissive window is fabricated into the vacuum vessel to allow the x-ray beam to exit at the desired location.

After exiting the vacuum vessel, the x-rays are directed to penetrate an object, such as human anatomical parts for medical examination and diagnostic procedures. The x-rays transmitted through the object are intercepted by a detector and an image is formed of the internal anatomy. Further, industrial x-ray tubes may be used, for example, to inspect metal parts for cracks or for inspecting the contents of luggage at airports.

The production of x-rays in a medical diagnostic x-ray tube is by its nature a very inefficient process. Typically less than one percent of the input power is converted to x-rays with the remainder being converted to heat in the anode. Consequently, the components in x-ray generating devices operate at elevated temperatures. For example, the focal spot on the anode can run as high as about 2700° C., while the bulk of the anode ranges up to about 1700° C. The excess heat from the anode must be transferred through the vacuum vessel and removed by a cooling fluid. Due to its close proximity to the focal spot, the x-ray window is subject to very high heat loads resulting from thermal radiation and back-scattered electrons from the target. These high thermal loads on the vacuum vessel x-ray transmissive window necessitate careful design to insure that the window remains intact over the life of the x-ray tube, especially in regards to vacuum integrity. Resulting large cyclic thermal stresses can cause vacuum leaks in the window joints resulting in premature failure of the x-ray tube.

The vacuum vessel is typically enclosed in a casing filled with circulating dielectric oil. The casing supports and protects the x-ray tube. Often the casing is lined with lead to provide stray radiation shielding. The oil often performs two duties, one is to cool the vacuum vessel by circulating over the vessel and drawing away the heat, and the second is to provide high voltage insulation between the anode and cathode connections. Alternatively, some prior art devices have attempted to cool the x-ray tube with circulating air.

The casing, typically made from aluminum, operates at a much lower temperature than the vacuum vessel, since the casing is not directly exposed to the high temperature anode and back-scattered electrons.

X-ray tubes with glass vacuum vessels typically do not include separate x-ray transmissive windows since the x-ray attenuation of glass in the medical diagnostic energy range, approximately 80 kV to 150 kV, is relatively low. Glass tubes use the vacuum vessel wall as the window. However, for x-ray tubes having metal vacuum vessels (typically made from stainless steel or a copper alloy), an x-ray transmissive window must be attached to an opening cut into the metal vessel because the x-ray attenuation (absorption) of the metal wall is very large.

A number of characteristics are considered desirable when choosing an x-ray transmissive window for an x-ray tube vacuum vessel. First, the x-ray attenuation coefficient of the window material must be small over the x-ray energy range of interest so that the maximum x-ray flux is transmitted. Second, the window must be able to withstand the high temperature operating environment of the x-ray tube. Third, the window material must be able to be joined to the vacuum vessel forming a reliable hermetic seal under atmospheric pressure and high thermal stresses.

The window should be relatively thin, on the order of 1 mm, to maximize x-ray throughput. As such, the window is generally fabricated from low atomic number materials, which inherently have low x-ray attenuation. This generally precludes any window materials of atomic number greater than that of titanium (atomic no. 22). Therefore, neither copper (atomic no. 29) nor stainless steel windows can be effectively used. The two most common methods of joining materials in x-ray tubes is high temperature brazing and welding. Welding is most applicable to joining similar metals. The differing materials typically used for the x-ray transmissive window and the vacuum vessel, thus generally do not lend themselves to welding. Reliable vacuum system brazing is generally performed with braze filler metals with liquidus points higher than 650° C. Therefore, the window material must be able to withstand the high brazing temperature.

In prior art x-ray generating devices, beryllium has been the material of choice for transmissive x-ray windows in metal x-ray tube vacuum vessels for a number of reasons. Beryllium has an extremely low x-ray attenuation coefficient that allows transmission of virtually all levels of x-rays. The attenuation coefficient of a material is related to the material's atomic number. Beryllium has an atomic number of 4, and as such is one of the most transmissive materials available. Also, beryllium possesses a high melting point, 1277° C., low vapor pressure, and good thermal conductivity, thus making beryllium an excellent material for the vacuum window. Additionally, because of its high melting point, beryllium can be brazed to the metal wall of the vacuum vessel, thereby providing a hermetic seal.

However, beryllium does have some serious drawbacks, especially with regard to ease of manufacture, safety, and cost. The machining and processing of beryllium require special precautions due to the toxicity of beryllium dust. At elevated temperature, an oxide of beryllium forms on its surface which can become dispersed in the environment if not properly handled. Beryllium is also a somewhat brittle material, so it is difficult to fabricate into complicated shapes. Further, because beryllium has such a low attenuation coefficient, it transmits low energy x-rays as well as diagnostic x-rays. In many instances, the lower energy x-rays simply add to the dose given to the patient, necessitating further attenuation by additional filters. Typically when a beryllium window is used, another x-ray filter must be added downstream of the x-ray tube to block out the lower energy x-rays. Thus, beryllium has a number of significant drawbacks as an x-ray transmissive window.

Another transmissive window material used in the prior art is titanium. The attenuation coefficient of titanium is much larger than that for beryllium, consequently, a titanium window must be very thin to provide comparable x-ray transmission. The relative thinness of a titanium window creates a structural problem that limits the size of the window because of the force due to atmospheric pressure on the window. Additionally, the thermal properties of titanium are quite poor in comparison to beryllium. The poor thermal properties of titanium result in very high window temperatures and thermal stresses. Consequently, titanium also has a number of significant drawbacks as an x-ray transmissive window.

Aluminum transmissive windows have been utilized in x-ray applications, such as for windows in the x-ray tube casing or as windows for image intensifier units, but generally not in the high temperature and high stress environment of an x-ray tube vacuum vessel. U.S. Pat. No. 4,045,699, U.S. Pat. No. 4,153,854 and U.S. Pat. No. 4,763,042, for example, disclose aluminum x-ray transmissive windows utilized in radiation image intensifiers. Radiation image intensifiers are vacuum vessels comprising electronic components that convert radiation into electrons to provide a illuminated image of the object subjected to the radiation. Image intensifiers typically operate near room temperature, as their delicate electronic components can be damaged or malfunction at high temperatures. Further, image intensifiers are not subject to very large mechanical and thermal operating stresses. Therefore, the environment of a transmissive window in an image intensifier is significantly different from the environment of an x-ray tube vacuum vessel transmissive window.

A two-layered x-ray transmissive window is disclosed in U.S. Pat. No. 4,045,699 for use in an image intensifier. One layer is formed of a light weight metal comprising the x-ray transmissive portion, the second layer is formed of a heavy weight metal comprising the weldable transition to the metal frame of the image intensifier. The specifically declared materials for the light weight material are aluminum and titanium and the heavy weight material being copper or iron. This layered material is formed in a commercial process by rolling the two materials under high pressure. This type of joining process is suitable for vacuum vessels operated at low temperature, such as an image intensifier. However, this type of joint would not form a reliable, long term seal in the high temperature, high stress environment of an x-ray tube vacuum vessel. The aluminum-copper and aluminum-iron joint is subject to the formation of an intermetallic layer, which makes the joint brittle and reduces the integrity of the vacuum seal, especially when subjected to the aggressive thermal cycling of an x-ray tube vacuum vessel. Additionally, as pointed out in U.S. Pat. No. 4,153,854, assigned to the same entity as U.S. Pat. No. 4,045,699, the two-layered sheet formed by high pressure rolling is disadvantageous because it lacks uniform quality and especially because it does not possess a uniform gas-permeable adherence between the two-layers. Additionally, the two-layered window was intended for use in the relatively passive, low temperature environment of a radiation image intensifier, rather than the high stress, high temperature environment of an x-ray tube vacuum vessel. As such, the reliability of the vacuum seal between the two-layered window as disclosed in U.S. Pat. No. 4,045,699 is not sufficient for use in an x-ray tube vacuum vessel.

Thus, there is a need for an x-ray transmissive window in a metal x-ray tube vacuum vessel with low x-ray attenuation that solves the above problems.

SUMMARY OF THE INVENTION

According to one aspect of the present invention, an x-ray transmissive window assembly for an x-ray tube vacuum vessel, comprises a non-toxic, ductile transmissive window having a sufficiently low x-ray attenuation coefficient to efficiently allow transmission of diagnostic x-rays, and that provides sufficient structural support and vacuum sealing capabilities within the operating environment of the x-ray tube vacuum vessel. Preferably the transmissive window comprises aluminum or an aluminum alloy. Further, the window assembly comprises a transition layer that forms a vacuum sealed joint with the transmissive window, wherein the joint is formed by explosion welding. The transition layer comprises a material selected from the group consisting of stainless steel, copper, titanium, molybdenum, nickel, and their alloys. Additionally, the transition layer material is removed from the center portions of the window assembly to form a frame about the periphery of the transmissive window.

In another aspect of the present invention, the window assembly may further comprise an intermediate layer for attenuating x-rays and providing a diffusion barrier that inhibits the formation of a brittle metallic interlayer between the transmissive window and the transition layer at elevated temperatures. The window assembly comprises a vacuum sealed joint, formed by explosion welding, between the transmissive window, the intermediate layer, and the transition layer. In this aspect, the transition layer and the intermediate layer are both removed from the central portions of the window assembly to form a frame about the periphery of the transmissive window. The intermediate layer may comprise a material selected from the group consisting of tungsten, tantalum, molybdenum, titanium, copper and their alloys.

According to another aspect of the present invention, an x-ray generating device, comprises an x-ray tube vacuum vessel, and an x-ray transmissive window assembly comprising a non-toxic, ductile transmissive window having a sufficiently low x-ray attenuation coefficient to efficiently allow transmission of diagnostic x-rays, and that provides sufficient structural support and vacuum sealing capabilities within the operating environment of the x-ray tube vacuum vessel. Similar to above, the transmissive window may comprise aluminum or an aluminum alloy. Further, the transmissive window assembly comprises a transition layer forming a vacuum sealed joint with the transmissive window, preferably formed by explosion welding. The transition layer comprises a material selected from the group consisting of stainless steel, copper, titanium, tungsten, molybdenum, nickel and their alloys. Also, the transition layer forms a frame about the periphery of the transmissive window.

Additionally, the device may comprise an intermediate layer for attenuating x-rays, wherein an explosion welded vacuum sealed joint is formed between the transmissive window, the intermediate layer, and the transition layer. The transition layer and the intermediate layer form a frame about the periphery of the transmissive window. The intermediate layer comprises a material selected from the group consisting of tungsten, tantalum, molybdenum, titanium, copper and their alloys.

DETAILED DESCRIPTION OF THE INVENTION

Figure 1:
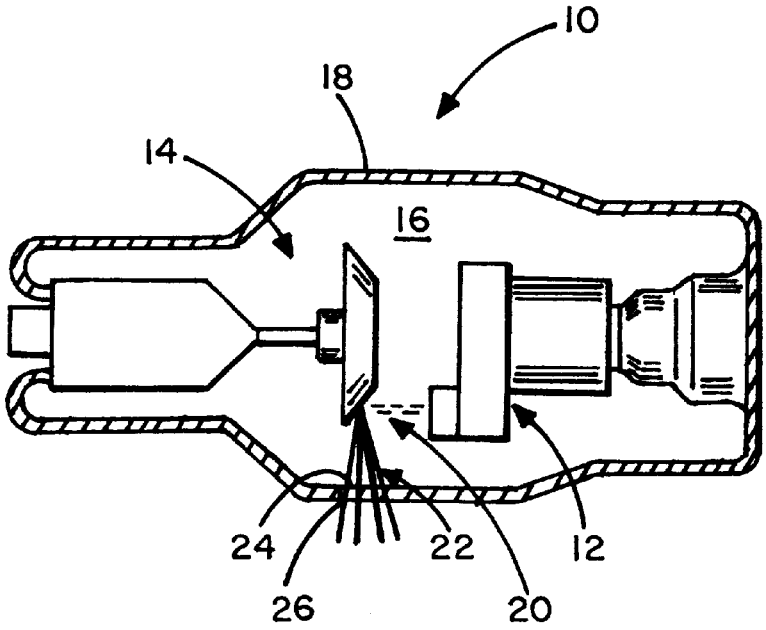
FIG. 1 is a partial cross-sectional side view of an x-ray generating device of the present invention.
Figure 2:
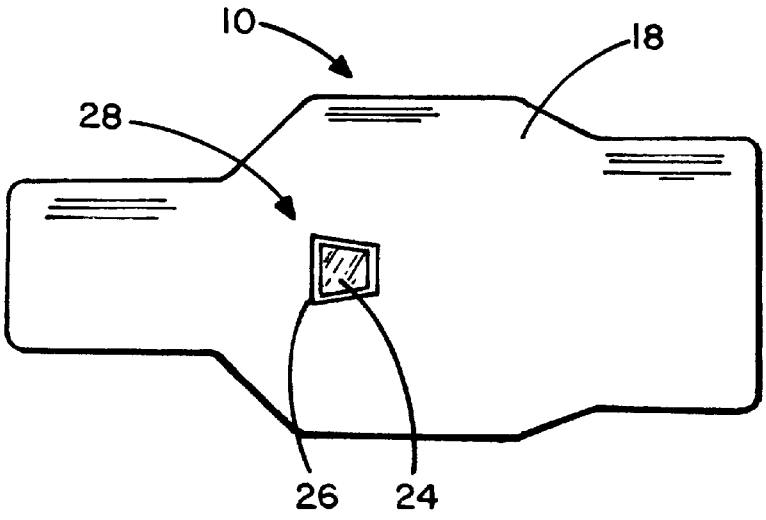
FIG. 2 is a bottom plan view thereof.
Figure 3:
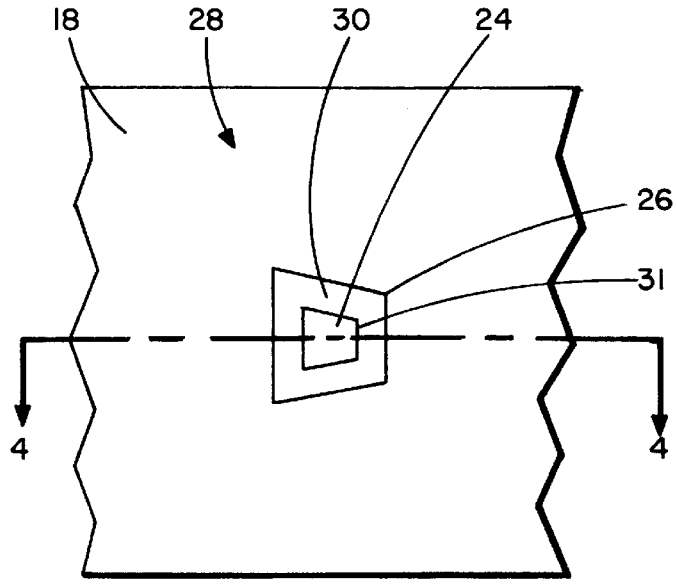
FIG. 3 is an partial plan view of the vacuum vessel and transmissive window from the inside of an x-ray generating device.
Figure 4:
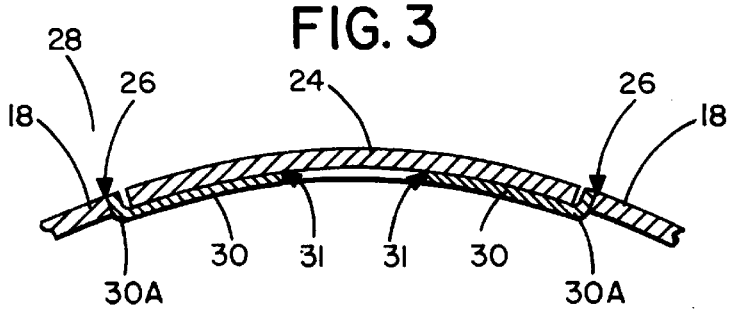
FIG. 4 is a cross-sectional view of an x-ray transmissive window taken along line 4—4 in FIG. 3.
Figure 5:
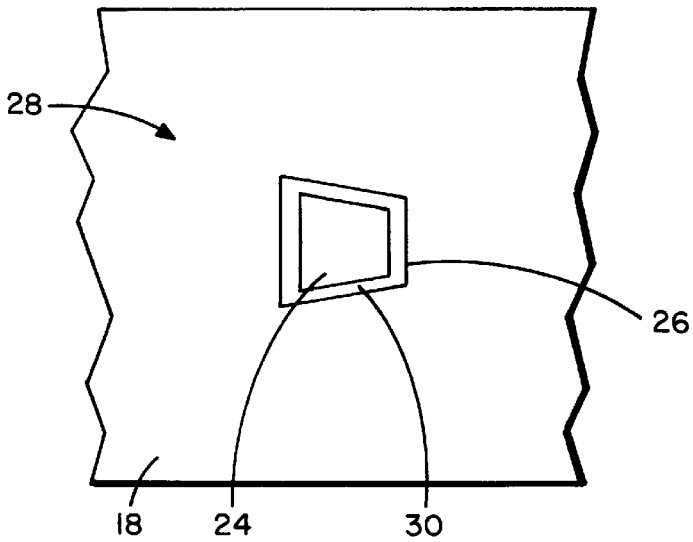
FIG. 5 is an partial plan view of the vacuum vessel and transmissive window from the outside of an x-ray generating device.

According to one aspect of the present invention, an x-ray transmissive window for an x-ray tube vacuum vessel comprises a non-toxic, ductile material having a relatively low cost and a sufficiently low x-ray attenuation coefficient to efficiently allow transmission of diagnostic x-rays. The x-ray transmissive window of the present invention preferably comprises aluminum or an aluminum alloy. Further, the x-ray transmissive window provides sufficient structural support and vacuum sealing capabilities within the operating environment of the x-ray tube vacuum vessel. The x-ray transmissive material is suitably bonded to one or more additional layers of other material by a process known as explosion welding. Explosion welding is a solid state metallurgical process for joining dissimilar metals under extremely high pressures. An explosive charge is detonated in a controlled fashion to drive one or more plates of metal together forming a very strong, highly reliable, ultra-high vacuum joint.

According to another aspect of the present invention, the x-ray transmissive window assembly comprises a transition layer to facilitate the joining of the window to the vacuum vessel using traditional welding techniques. The transition layer is preferably formed at the periphery of the window and bonds the window to the vacuum vessel to form a joint sufficient to withstand the vacuum pressure inside the vacuum vessel. Additionally, the window and joint provide sufficient structural support to withstand the loads applied to the window and joint through the vacuum vessel. The transition layer is advantageously joined to the x-ray transmissive window material by explosion welding, and then conventionally welded to the vacuum vessel to form a vacuum joint. The transition layer typically comprises any material that provides sufficient welding capabilities to the vacuum vessel. With an aluminum x-ray transmissive window and a stainless steel vacuum vessel, for example, the transition material is preferably stainless steel. For an aluminum window and a copper vacuum vessel, the transition layer is preferably copper.

Suitable x-ray transmissive window materials have low attenuation in the x-ray energy range of interest, high thermal conductivity, high yield strength at elevated temperatures, low vapor pressure, low toxicity, and are easy to manufacture. Aluminum and it's alloys are an excellent material in all of these regards. The transmission of aluminum in the diagnostic energy range is very comparable to that of beryllium. For example, the integrated intensity from 75 kV to 120 kV for a 1.5 mm thick aluminum window is 96% of that transmitted by a beryllium window of the same thickness. The thermal conductivity of aluminum is superior to beryllium at elevated temperatures, allowing it to effectively conduct heat away. Aluminum and its common alloys have a melting point of about 630° C., and thus are able to withstand the operating environment of the x-ray tube vacuum vessel The yield strength of annealed aluminum is about 6000 psi. This strength is sufficient to withstand the mechanical stresses due to atmospheric pressure and thermal loads. Additionally, aluminum is a ductile, non-toxic material that is easily and inexpensively manufactured. The vapor pressure of aluminum is similar to beryllium at the x-ray tube operating temperatures.

Further, the transmissive aluminum window of the present invention advantageously has a low enough x-ray attenuation coefficient to allow for the efficient transmission of diagnostic x-rays while filtering out a larger fraction of the lower energy, non-diagnostic x-rays, compared to a beryllium window of similar thickness. The definition of usable x-rays will vary depending on the application. For example, in computed tomography applications, the useful diagnostic energy range is from about 80 keV to 140 keV. An electron volt (eV) is a unit of energy which is equal to the energy acquired by an electron when it is accelerated through a potential difference of 1 volt in a vacuum. X-rays with energy lower than 80 keV are not used in image formation, but contribute to the radiation dose the patient receives, and thus exposure to these levels of radiation should be avoided if possible. The transmissive window of the present invention preferably filters out a larger fraction of the x-rays below 80 keV compared to the same thickness of beryllium.

The present invention advantageously utilizes explosion welding to join the aluminum window material to the transition layer material, which is welded using traditional methods to the vacuum vessel. This arrangement produces a reliable vacuum seal and overcomes the traditional problems associated with joining aluminum to other metals. Joining an aluminum window to a stainless steel or copper vacuum vessel is problematic for a number of reasons. A suitable weld joint cannot be readily made between aluminum and the dissimilar metal of the vacuum vessel. Also, it is difficult to make a suitable braze joint, because there is a natural oxidation layer on the surface of the aluminum that prohibits wetting of the braze filler metal. Further, the high temperatures of the braze process would melt aluminum and its alloys, which typically have melting points in the range of about 600–650° C. This melting point limitation is important because there are few, if any, braze materials with liquidus temperatures below about 650° C. that perform satisfactorily in the vacuum environment of an x-ray tube. Additionally, traditional welding and brazing result in flat, planar interfaces between the material being bonded together. An explosion weld, however, forms a wavy, interlocking interface between the two materials. This wavy, interlocking interface provides more surface area for bonding the materials together, resulting in a stronger and more reliable bond. Thus, the present invention overcomes traditional problems with bonding aluminum to other metals by providing a transmissive window advantageously explosion welded to a transition layer.

In yet another aspect, the present invention solves the traditional problem of diffusion and the formation of brittle intermetallic compounds between aluminum and copper joints or aluminum and stainless steel joints that occurs when the joint is exposed to the elevated temperatures, such as in the x-ray tube vacuum vessel environment during operation and in the high temperature exhaust processing of the unit prior to operation. The present invention advantageously provides a third material or intermediate layer placed between the aluminum window material and the transition layer material to act as a diffusion barrier that prevents the formation of brittle intermetallics in the joint between the aluminum and the transition layer at elevated temperatures. This intermediate layer has the additional advantage of acting as an aperture or mask to effectively attenuate the x-rays outside the periphery of the transmissive window region. This aperture/mask helps filter off-focal and peripheral radiation and define the shape of the x-ray beam exiting the x-ray tube vacuum vessel. This improves the image quality and lowers the non-imaging x-ray dose the patient or object receives. The mask/aperture is preferably tantalum, but may also be tungsten, molybdenum, titanium and their alloys or other similar materials that attenuate high energy x-rays and provide a diffusion barrier between the aluminum and the transition material.

Referring to FIG. 1, a typical x-ray generating device 10 comprises a cathode assembly 12 and a rotating, disc-shaped anode assembly 14 within a vacuum chamber 16 in an x-ray tube vacuum vessel 18. Upon energization of the electrical circuit connecting cathode assembly 12 and anode assembly 14, a stream of electrons 20 are directed and accelerated toward anode assembly 14. The stream of electrons 20 strikes the surface of anode assembly 14 and produce high frequency electromagnetic waves or x-rays 22. X-rays 22 are directed through vacuum chamber 16 and out of vacuum vessel 18 through transmissive window 24. Transmissive window 24 and vacuum vessel 18 are joined at joint 26, which provides a seal to insure the vacuum integrity of chamber 16.

Vacuum vessel 18 is constructed of a material that is able to structurally handle the loads generated by vacuum chamber 16 and the rotating anode assembly 14 in a high temperature environment. Vacuum vessel 18 is preferably stainless steel, but may be copper, nickel, molybdenum, their alloys or other similar metals, and is formed using well-known manufacturing methods. Vacuum vessel 18 must be able to withstand the high temperatures of the x-ray generating device 10 environment. For example, anode 14 operates from about 500–2700° C., cathode 12 up to about 600° C. and vacuum vessel 18 operates up to about 300° C. Vacuum vessel 18 is heated by the operating temperatures within chamber 16, and further by absorption of x-rays 22, scattered electrons and infrared (thermal) radiation within chamber 16.

Referring to FIGS. 2–5, according to one embodiment of the present invention a dual-layered window assembly 28 in an x-ray tube vacuum vessel 18 comprises an aluminum or aluminum alloy transmissive window 24 explosion welded to a transition layer 30. The material of transition layer 30 is removed from the central portion of assembly 28, thereby creating the x-ray transmissive window 24. At the periphery of assembly 28, the material of window 24 is removed leaving a suitable weld flange 30*a* of transition layer 30 material weldable to vacuum vessel 18. The joint 31 between window 24 and transition layer 30 formed by the explosion welding process is a vacuum joint that is highly reliable in high temperature and high stress environments. Transition layer 30 preferably comprises stainless steel, but may be tungsten, titanium, copper, molybdenum, nickel, their alloys and other similar metals that are readily weldable to vacuum vessel 18.

Window assembly 28 is formed by explosion welding a sheet of material of transmissive window 24 to a sheet of the transition layer 30 together in one explosive process. The resulting laminated panel is then machined using conventional methods, such as milling, to remove the transition layer from the center portion of the panel. Similarly, the window material is machined away from the edges of the panel, leaving the weld flange 30*a* exposed. Transition layer 30 thus forms a peripheral frame about transmissive window 24, extending beyond the edges of window 24 to form window assembly 28. Window assembly 28 may be formed to any required curvature, as the combination of materials forming the window assembly are not as brittle as a typical beryllium window. Finally, weld flange 30*a* is conventionally welded to vacuum vessel 18 to form joint 26. Weld flange 30*a* may be joined to vacuum vessel 18 using conventional methods, such as arc welding, electron beam welding, torch welding, laser welding, and the like. Thus, window assembly 28 seals vacuum chamber 18 with a combination of vacuum sealed joints 31 and 26, joint 31 formed between transmissive window 24 and transition layer 30 by explosion welding and joint 26 formed between transition layer 30 and x-ray tube vacuum vessel 18 by conventional welding.

As described above, there may be numerous combinations of materials used for window 24, transition layer 30 and vacuum vessel 18. Some examples of such combinations for dual-layered window assembly 28 are:

Materials:

| Window 24 | Transition Layer 30 | Vacuum vessel 18 |
|---|---|---|
| aluminum, aluminum alloys | stainless steel, copper, titanium, molybdenum, nickel, tungsten, and their alloys | stainless steel, copper nickel, molybdenum and their alloys |

Any combination of any of the above materials, or any other like materials, may be utilized in the present invention.

Figure 6:
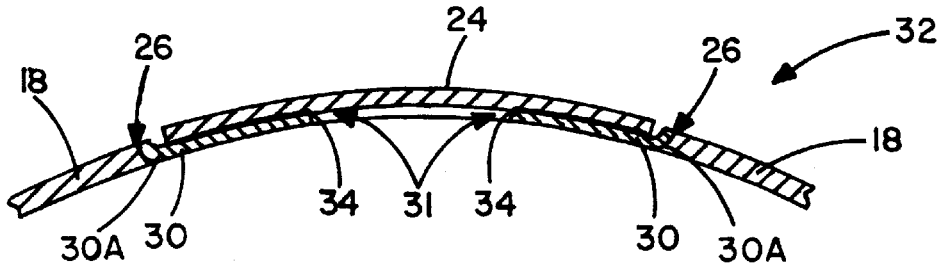
FIG. 6 is a cross-sectional view, similar to FIG. 4, of a preferred embodiment of an x-ray transmissive window.

Referring to FIG. 6, according to another embodiment of the present invention a multi-layered window assembly 32 in an x-ray tube vacuum vessel comprises window 24 explosion welded to both intermediate layer 34 and transition layer 30. Window 24 and transition layer 30 comprise the same materials as described above, while intermediate layer 34 preferably comprises a material that has a relatively high x-ray attenuation coefficient so that the intermediate layer inhibits the passage of x-rays. As a result, intermediate layer 34 advantageously helps to focus the x-rays exiting the x-ray tube vacuum vessel. Intermediate layer 34 is preferably tungsten, but tantalum, molybdenum, titanium, copper, their alloys and other similar materials may also be utilized.

Multi-layered window assembly 32 is formed similarly to dual-layered window assembly 28, as described above. In the explosion welding process, however, the sheet of material for intermediate layer 34 is inserted and bonded between window 24 and transition layer 30 to form a reliable high temperature, high stress vacuum joint 31. The material for intermediate layer 34 is removed from the central portion and periphery of multi-layered window assembly 32, similar to the process described above. Window assembly 32 is conventionally welded to vacuum vessel 18 at weld flange 30*a* to form vacuum joint 26. As a result, intermediate layer 34 acts as an aperture or mask that filters off-focal and peripheral radiation and defines the shape of the x-ray beam 22 exiting the x-ray tube vacuum vessel 18. This improves the image quality and lowers the non-imaging x-ray dose the patient receives. Additionally, intermediate layer 34 placed between transmissive window 24 and transition layer 30 acts as a diffusion barrier that prevents the formation of brittle intermetallics in the joint 31 between the transmissive window and the transition layer at elevated temperatures.

Figure 7:
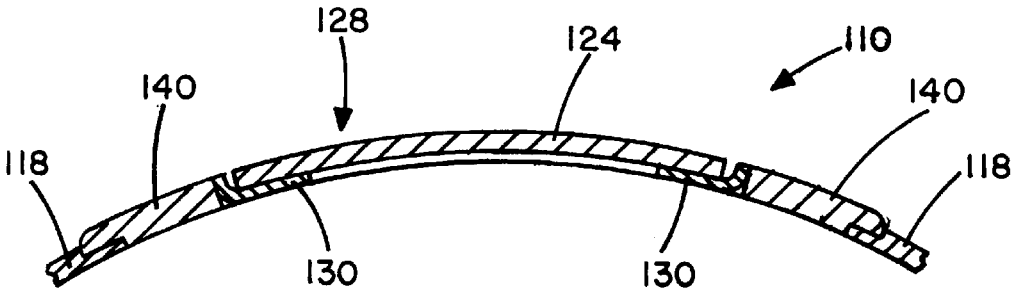
FIG. 7 is a cross-sectional view, similar to FIGS. 4 and 6, of yet another embodiment of a transmissive window for an x-ray generating device.

Referring to FIG. 7, another embodiment of present invention comprises an x-ray generating device 110 comprising vacuum vessel 118 having insert 140 forming a cut-out for window 124. Insert 140 may be joined to vacuum vessel 118 by brazing, welding or other conventional means. Suitable materials for insert 140 comprise the same materials as listed above for transition layer 30, or any other materials that may be joined to vessel 118 to form a vacuum seal. Window 124 is explosion bonded to transition layer 130 to form dual layered window assembly 128. Insert 140 may be desired when retrofitting window assembly 128 onto a vacuum vessel 118, such as a vacuum vessel that had previously incorporated a beryllium window. The combination of window assembly 128 and insert 140 form a reliable vacuum seal with each other and with vacuum vessel 118.

Figure 8:
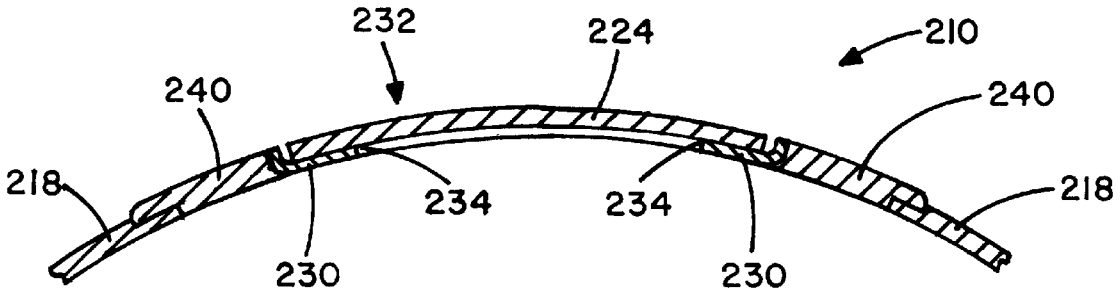
FIG. 8 is a cross-sectional view, similar to FIG. 7, of another embodiment of a transmissive window for an x-ray generating device.

Referring to FIG. 8, yet another embodiment of the present invention comprises x-ray generating device 210 comprising vacuum vessel 218 having insert 240 forming a cut-out for window 224. Insert 240 may be joined to vacuum vessel 218 by brazing, welding or other conventional means. Suitable materials for insert 240 comprise the same materials as listed above for transition layer 30, or any other materials that may be joined to vessel 218 to form a vacuum seal. Window 224 is explosion bonded with intermediate layer 234 and transition layer 230 to form multi-layered window assembly 228. Intermediate layer 234 is similar to the intermediate layer described above, providing a filter for off-focal radiation and a diffusion barrier to prevent the formation of a metallic interlayer. Insert 240 may be desired when retrofitting window assembly 228 onto a vacuum vessel 218, such as a vacuum vessel that had previously incorporated a beryllium window. The combination of window assembly 228 and insert 240 form a reliable vacuum seal with each other and with vacuum vessel 218.

Figure 9A:
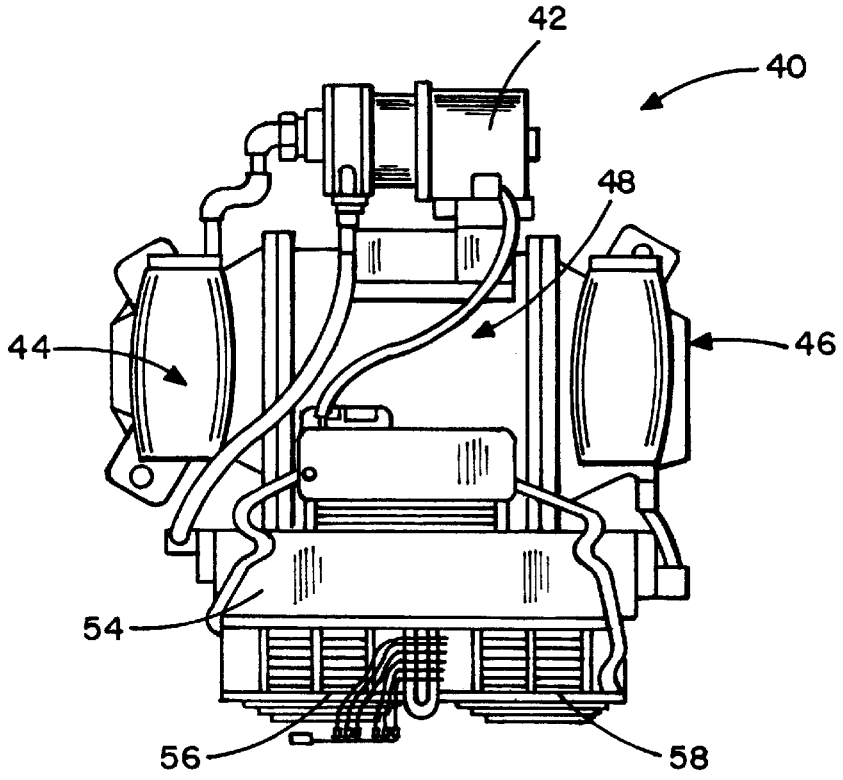
FIG. 9*a* is a plan view of a representative x-ray system having an x-ray generating device or x-ray tube positioned therein.
Figure 9B:
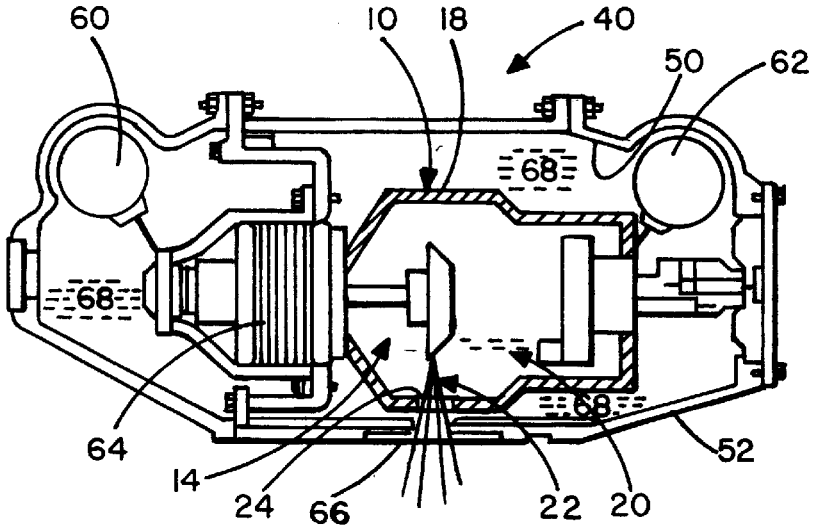
FIG. 9*b* is a sectional view with parts removed of the x-ray system of FIG. 9*a* including the x-ray generating device.

Referring to FIGS. 9*a*–9*b*, the present invention is typically utilized in an x-ray system 40. A typical x-ray system 40 comprises an oil pump 42, an anode end 44, a cathode end 46, and a center section 48 positioned between the anode end and cathode end, which contains the x-ray generating device or x-ray tube 10 of FIG. 1. The x-ray generating device 10 is enclosed in a fluid chamber 50 within lead-lined casing 52 (FIG. 9*b*). Chamber 50 is typically filled with fluid 68, such as dielectric oil, but other fluids including air may be utilized. Fluid 68 circulates through system 40 to cool the x-ray generating device and to insulate casing 52 from the high electrical charges within vacuum vessel 18. A radiator 54 for cooling fluid 68 is positioned to one side of the center section and may have fans 56 and 58 operatively connected to the radiator 54 for providing cooling air flow over the radiator as the hot oil circulates through it. Oil pump 42 is provided to circulate the oil through system 40 and through radiator 54, etc. Electrical connections are provided in anode receptacle 60 and cathode receptacle 62 (FIG. 9*b*) for energizing system 40.

Referring to FIG. 9*b*, x-ray system 40 comprises casing 52 preferably made with aluminum and lined with lead to block x-ray passage. X-ray generating device or x-ray tube 10 within system 40 is as described above with regard to FIG. 1. As stated above, very high voltages and currents are utilized in x-ray generating device 10, with voltages ranging from about 80 kV to 150 kV and currents ranging from about 250 to 550 mA. A stator 64 is positioned outside vacuum vessel 18 inside lead-lined casing 52 relative to rotating disc-like target anode 14. Window 66 for emitting x-rays from system 40 toward an object (as described above) is operatively formed in casing 52 relative to transmissive window 24 in vacuum vessel 18.

Casing 52 primarily contains the circulating fluid 68 within chamber 50, blocks the generated x-rays 22 in all areas but window 64, and serves to house x-ray generating device 10. Casing 52 is not subject to the high temperatures and vacuum pressures associated with vacuum vessel 18.

In summary, the advantages of the explosion welded aluminum transmissive window of the present invention are: it is less expensive than beryllium; it is easily machined, bent, rolled, and formed without special precautions; there are no special disposal requirements; it is a non-hazardous material; the explosion weld has very high strength and vacuum integrity; and the integral mask/aperture defines the beam shape and filters off-focal x-rays. The intermediate layer also prevents the formation of brittle intermetallics at the joint between the x-ray transmissive window material and the transition layer.

Vacuum joints in the prior art, such as beryllium brazed to stainless steel, are predisposed to failure due to the mismatch between the coefficients of thermal expansion of the two materials. The joint of the present invention is more robust than a brazed beryllium to stainless steel joint because the explosion weld creates an integral joint that totally bonds the materials together. Often the explosion formed joint is stronger than the base materials. Further, the weld between the vacuum vessel and transition layer is more robust than a beryllium to stainless braze especially in the case when two identical materials are used, such as in transition layer/vacuum vessel combinations like stainless steel/stainless steel and copper/copper.

Still further beneficial features of the present invention are that the aluminum window is more readily machined and formed than beryllium or titanium x-ray vacuum vessel windows. Because beryllium is so brittle, many prior art x-ray tube vacuum vessels have a machined flat land area so that a flat beryllium window can be used. In the present invention, however, the aluminum window can be easily formed to match the contour of the vacuum vessel without having to specially machine a flat area for the window, thus improving the overall economy.

Additionally, aluminum forms a non-toxic, stable oxide layer when exposed to air. On the other hand, beryllium oxide forms on a beryllium window exposed to air, especially at elevated temperatures. Beryllium oxide is very toxic and dangerous if inhaled. In order to avoid this problem, when beryllium is used in applications where it is exposed to air at elevated temperatures, the beryllium must be coated to seal it from the air. In cases where an x-ray tube vacuum vessel utilizes air for cooling, this adds extra concern and manufacturing cost to the product. Thus, the aluminum transmissive window of the present invention advantageously may be exposed to air without special processing or regard for health and environmental issues.

Figure 10:
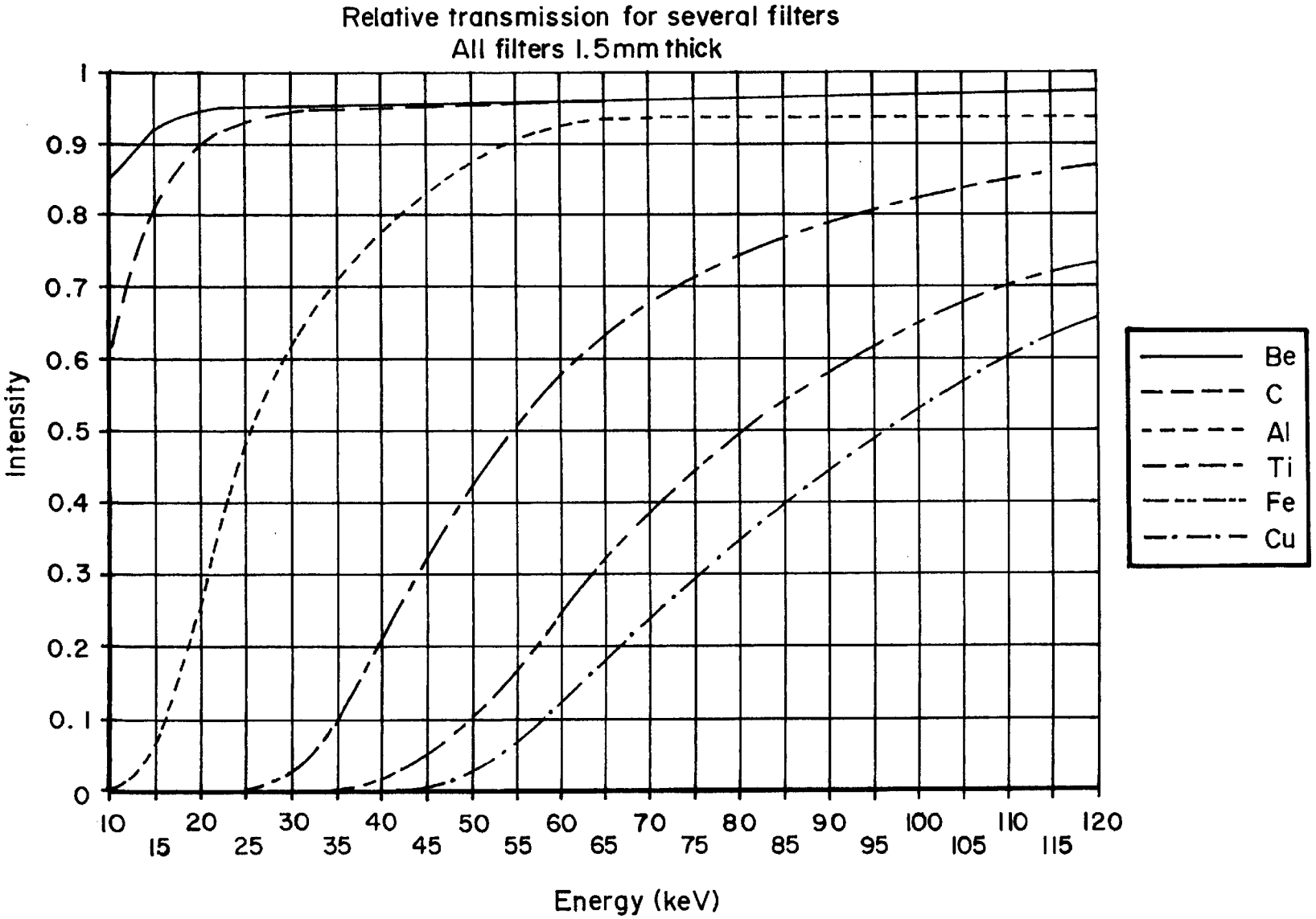
FIG. 10 is a graph showing the relative x-ray transmission of 1.5 mm thick windows of beryllium (Be), carbon graphite (C), aluminum (Al), titanium (Ti), iron (Fe), and copper (Cu), where Intensity, relative to the transmissiveness of the window, is on the vertical axis and Energy in thousands of electron volts is on the horizontal axis.

Finally, the aluminum transmissive window of the present invention advantageously filters out low energy x-rays. Referring to FIG. 10, the graph represents the relative x-ray transmission for 1.5 mm thick windows of various materials and at various energy levels. At the lower energy levels, aluminum is significantly less transmissive than beryllium. At the diagnostic energy levels, however, aluminum is about 96% as transmissive as beryllium. Thus, the aluminum transmissive window of the present invention advantageously alleviates the need for extra downstream filters to block low energy x-rays, as are often required when using beryllium windows.

Although the invention has been described with reference to these preferred embodiments, other embodiments can achieve the same results. Variations and modifications of the present invention will be apparent to one skilled in the art and the following claims are intended to cover all such modifications and equivalents.

What is claimed is:

1. An x-ray transmissive window assembly for an x-ray tube vacuum vessel, comprising:

a non-toxic, ductile, transmissive window having a sufficiently low x-ray attenuation coefficient to efficiently allow transmission of diagnostic x-rays; and a transition layer comprising a metal and forming a vacuum sealed joint with said transmissive window, said vacuum sealed joint capable of withstanding the operating environment of said x-ray tube vacuum vessel.

2. An x-ray transmissive window assembly as recited in claim 1, wherein said transmissive window comprises aluminum.

3. An x-ray transmissive window assembly as recited in claim 2, wherein said transition layer comprises stainless steel.

4. An x-ray transmissive window as recited in claim 2, wherein said transition layer comprises a material selected from the group consisting of stainless steel, copper, titanium, molybdenum, nickel, and their alloys.

5. An x-ray transmissive window assembly as recited in claim 3, wherein said vacuum sealed joint is formed between said transmissive window and said transition layer by explosion welding.

6. An x-ray transmissive window assembly as recited in claim 5, wherein said transition layer forms a frame about the periphery of said transmissive window.

7. An x-ray transmissive window assembly for an x-ray tube vacuum vessel, comprising:

a non-toxic, ductile, transmissive window having a sufficiently low x-ray attenuation coefficient to efficiently allow transmission of diagnostic x-rays; and an intermediate layer for attenuating x-rays and a transition layer, wherein a vacuum sealed joint is formed between said transmissive window, said intermediate layer, and said transition layer, said vacuum sealed joint capable of withstanding the operating environment of said x-ray tube vacuum vessel, and wherein said transmissive window comprises aluminum.

8. An x-ray transmissive window assembly as recited in claim 7, wherein said transition layer and said intermediate layer form a frame about the periphery of said transmissive window.

9. An x-ray transmissive window as recited in claim 7, wherein said transition layer comprises a material selected from the group consisting of stainless steel, copper, titanium, tungsten, molybdenum, nickel and their alloys.

10. An x-ray transmissive window assembly as recited in claim 7, wherein said intermediate layer comprises a material selected from the group consisting of tungsten, tantalum, molybdenum, titanium, copper and their alloys.

11. An x-ray transmissive window assembly as recited in claim 7, wherein said vacuum sealed joint is formed by explosion welding said transmissive window, said intermediate layer and said transition layer.

12. An x-ray generating device, comprising:

an x-ray tube vacuum vessel;

an x-ray transmissive window assembly comprising a non-toxic, ductile, transmissive window having a sufficiently low x-ray attenuation coefficient to efficiently allow transmission of diagnostic x-rays, and that provides sufficient structural support within the operating environment of said x-ray tube vacuum vessel; and a transition layer comprising a metal and forming a vacuum sealed joint with said transmissive window, said vacuum sealed joint capable of withstanding the operating environment of said x-ray tube vacuum vessel.

13. An x-ray generating device as recited in claim 12, wherein said transmissive window comprises aluminum.

14. An x-ray generating device as recited in claim 13, wherein said transition layer comprises stainless steel.

15. An x-ray generating device as recited in claim 13, wherein said transition layer comprises a material selected from the group consisting of stainless steel, copper, titanium, tungsten, molybdenum, nickel and their alloys.

16. An x-ray generating device as recited in claim 14, wherein said vacuum sealed joint is formed between said transmissive window and said transition layer by explosion welding.

17. An x-ray generating device as recited in claim 16, wherein said transition layer forms a frame about the periphery of said transmissive window.

18. An x-ray generating device, comprising:

an x-ray tube vacuum vessel;

an x-ray transmissive window assembly comprising a non-toxic, ductile transmissive window having a sufficiently low x-ray attenuation coefficient to efficiently allow transmission of diagnostic x-rays, and that provides sufficient structural support within the operating environment of said x-ray tube vacuum vessel; and an intermediate layer for attenuating x-rays and a transition layer, wherein a vacuum sealed joint is formed between said transmissive window, said intermediate layer, and said transition layer, said vacuum sealed joint capable of withstanding the operating environment of said x-ray tube vacuum vessel, and wherein said transmissive window comprises aluminum.

19. An x-ray generating device as recited in claim 18, wherein said transition layer and said intermediate layer form a frame about the periphery of said transmissive window.

20. An x-ray generating device as recited in claim 18, wherein said transition layer comprises a material selected from the group consisting of stainless steel, copper, titanium, tungsten, molybdenum, nickel and their alloys.

21. An x-ray generating device as recited in claim 18, wherein said intermediate layer comprises a material selected from the group consisting of tungsten, tantalum, molybdenum, titanium, copper and their alloys.

22. An x-ray generating device as recited in claim 18, wherein said vacuum sealed joint is formed between said transmissive window and said transition layer by explosion welding.

23. An x-ray transmissive window assembly as recited in claim 1, wherein said vacuum sealed joint comprises a wavy, interlocking interface.

24. An x-ray transmissive window assembly as recited in claim 1, further comprising an intermediate layer between said transmissive window and said transition layer, said intermediate layer comprising a metal that acts as a diffusion barrier between said transmissive window and said transition layer.

25. An x-ray transmissive window assembly as recited in claim 3, further comprising an intermediate layer between said transmissive window and said transition layer, said intermediate layer comprising a material selected from the group consisting of tungsten, tantalum, molybdenum, titanium, copper and their alloys.

26. An x-ray transmissive window assembly as recited in claim 3, further comprising an intermediate layer between said transmissive window and said transition layer, said intermediate layer comprising tungsten.

27. An x-ray transmissive window assembly as recited in claim 7, wherein said vacuum sealed joint comprises a wavy, interlocking interface.

28. An x-ray transmissive window assembly as recited in claim 7, wherein said transition layer comprises stainless steel.

29. An x-ray transmissive window assembly as recited in claim 28, wherein said intermediate layer comprises tungsten.

30. An x-ray generating device for diagnostic medical imaging, comprising:

an x-ray tube vacuum vessel;

a non-toxic, ductile transmissive window having a sufficiently low x-ray attenuation coefficient to efficiently allow transmission of diagnostic medical x-rays;

a transition layer forming a peripheral frame about said window and for attachment to said vacuum vessel to form a first vacuum sealed joint;

an intermediate layer forming a peripheral frame about said window and forming a diffusion barrier that prevents the formation of brittle intermetallics between said window and said transition layer at the operating temperatures of said x-ray generating device; and a second vacuum sealed joint formed by explosion welding between said transmissive window, said intermediate layer and said transition layer, said vacuum sealed joint capable of withstanding the operating environment of said x-ray generating device.

31. An x-ray generating device as recited in claim 30, wherein said vacuum sealed joint comprises a wavy, interlocking interface.

32. An x-ray generating device as recited in claim 31, wherein said intermediate layer comprises a metal having a high degree of x-ray attenuation relative to said transmissive window.

33. An x-ray generating device as recited in claim 32, wherein said window comprises aluminum.

34. An x-ray generating device as recited in claim 33, wherein said transition layer comprises a material selected from the group consisting of stainless steel, copper, titanium, tungsten, molybdenum, nickel and their alloys.

35. An x-ray generating device as recited in claim 33, wherein said transition layer comprises stainless steel.

36. An x-ray generating device as recited in claim 34, wherein said intermediate layer comprises a material selected from the group consisting of tungsten, tantalum, molybdenum, titanium, copper and their alloys.

37. An x-ray generating device as recited in claim 35, wherein said intermediate layer comprises tungsten.

* * * * *